US010704259B2

(12) United States Patent
Kim

(10) Patent No.: US 10,704,259 B2
(45) Date of Patent: Jul. 7, 2020

(54) GONGPO ASSEMBLY STRUCTURE OF TRADITIONAL KOREAN-STYLE HOUSE AND TEMPLE

(71) Applicant: Jin Woo Kim, Gangwon-do (KR)

(72) Inventor: Jin Woo Kim, Gangwon-do (KR)

( * ) Notice: Subject to any disclaimer, the term of this patent is extended or adjusted under 35 U.S.C. 154(b) by 0 days.

(21) Appl. No.: 16/076,623

(22) PCT Filed: Feb. 22, 2017

(86) PCT No.: PCT/KR2017/001944
§ 371 (c)(1),
(2) Date: Aug. 8, 2018

(87) PCT Pub. No.: WO2017/146460
PCT Pub. Date: Aug. 31, 2017

(65) Prior Publication Data

US 2019/0048586 A1 Feb. 14, 2019

(30) Foreign Application Priority Data

Feb. 23, 2016 (KR) ..... 10-2016-0021327
Dec. 22, 2016 (KR) ..... 10-2016-0177115
Feb. 22, 2017 (KR) ..... 10-2017-0023537

(51) Int. Cl.
*E04B 7/04* (2006.01)
*E04B 7/02* (2006.01)
(Continued)

(52) U.S. Cl.
CPC ..... *E04B 7/04* (2013.01); *E04B 1/2604* (2013.01); *E04B 7/02* (2013.01); *E04D 1/30* (2013.01);
(Continued)

(58) Field of Classification Search
CPC . E04B 7/04; E04B 7/02; E04B 1/2604; E04D 1/30; E04D 1/3405
See application file for complete search history.

(56) References Cited

U.S. PATENT DOCUMENTS 1,425,107 A * 8/1922 Levinson ..... A63F 9/12 273/160
1,763,748 A * 6/1930 Best ..... F16B 12/48 211/196
(Continued)

FOREIGN PATENT DOCUMENTS

JP H01310036 A 12/1989
KR 200363394 Y1 9/2004
(Continued)

OTHER PUBLICATIONS

International Search Report; dated Jun. 1, 2017 for PCT Application No. PCT/KR2017/001944.

*Primary Examiner* — Paola Agudelo
(74) *Attorney, Agent, or Firm* — Mendelson Dunleavy, P.C.

(57) ABSTRACT

The present invention relates to a gongpo assembly structure of a traditional Korean-style house and temple, the gongpo assembly structure including: at least one gongpo fixing member provided with an interlocking slot formed in a shape depressed toward lower and inward directions from an surface thereof, and laid one upon another by being fastened to the fixed object; a judu provided with a wide open groove formed on a center of a top surface thereof and an interlocking protrusion formed on one side wall thereof and interlocked with the interlocking slot of the gongpo fixing member; and a gongpo provided with an interlocking slot and interlocking protrusion, and assembled with a top of the judu. Accordingly, the gongpo may be standardized and mass-produced at a factory, thereby allowing a general
(Continued)

technician to easily perform work only done by a master previously.

2 Claims, 7 Drawing Sheets

(51) Int. Cl.
*E04D 13/00* (2006.01)
*E04B 1/26* (2006.01)
*E04D 1/30* (2006.01)
*E04D 1/34* (2006.01)

(52) U.S. Cl.
CPC ..... *E04D 1/3405* (2013.01); *E04D 13/00* (2013.01); *E04B 2001/2624* (2013.01); *E04B 2001/2652* (2013.01); *E04D 2001/303* (2013.01)

(56) References Cited

U.S. PATENT DOCUMENTS 3,866,371 A * 2/1975 Falconer ..... E04B 1/185 52/281
3,966,337 A * 6/1976 Crawford ..... F16B 12/02 403/170
4,409,763 A * 10/1983 Rydeen ..... E04B 1/26 52/93.2
4,540,308 A * 9/1985 Colby ..... F16B 12/00 211/189
4,873,797 A * 10/1989 Rydeen ..... E04B 1/10 52/93.1
4,880,238 A * 11/1989 Derouin ..... A63F 9/12 273/160
5,040,797 A * 8/1991 Dykstra ..... A63F 9/12 273/160
5,185,982 A * 2/1993 Hostetler ..... F16B 7/044 211/189
5,685,120 A * 11/1997 Sihra ..... A63H 33/06 273/156
5,799,452 A * 9/1998 Moore ..... E04B 1/2604 52/233
6,241,248 B1 * 6/2001 Winter ..... A63F 9/12
2016/0369492 A1 * 12/2016 Ko ..... E04B 1/165

FOREIGN PATENT DOCUMENTS

KR 1020050078083 A 8/2005
KR 100869149 B1 11/2008
KR 1020150112476 A 10/2015

* cited by examiner

GONGPO ASSEMBLY STRUCTURE OF TRADITIONAL KOREAN-STYLE HOUSE AND TEMPLE

TECHNICAL FIELD

The present invention relates to a gongpo assembly structure of a traditional Korean-style house, known as a hanok, and temple, wherein the gongpo assembly structure can be quickly and easily attached to or detached from the inside and outside of a fixed object on a construction site. In addition, the gongpo assembly structure formed in various styles and shapes is standardized to be suitable for a design of a hanok and temple, thereby being manufactured and assembled in advance at a factory.

BACKGROUND ART

Generally, on the one hand a gongpo, known as a corbel bracket set, functions as a structural safety buffer by distributing or concentrating a weight of a building roof. On the other hand, the gongpo shows a magnificent appearance by expanding an interior space and raising a building height. Furthermore, the gongpo has an important function for decorative purposes with delicate and gorgeous composition and structures thereof.

Here, the gongpo is classified into: a jusimpo-style, known as a columnar packaging style; a dapo-style, known as a multi-package style; and an ikkong-style, known as a wing style, depending on a position where the gongpo is placed and a method how the gongpo is combined. In addition, shapes and sizes of the gongpo vary depending on a temple or hanok.

Among them, the jusimpo-style is a style in which a gongpo is woven only on top of a column, a transverse member called changbang is laid between columns by encroaching top of each column with each end thereof, correspondingly, and a hwaban, known as a flower pot, or a pobyeog, known as an open wall, is formed at the center of the changbang.

On the other hand, the dapo-style is a style with a very gorgeous appearance where a gongpo lies not only on top of a column but also between columns. Since a weight of a roof is transmitted through walls as well as columns, it is difficult for a changbang alone to support a load, wherein the changbang is a transverse member connecting with each top of columns. Accordingly, one more transverse member called a pyeongbang is placed on the changbang and the gongpo is formed on the pyeongbang.

In addition, the ikkong-style is a style in which a member is put to be engaged into a top of a column and decorates a gongpo by weaving a judo, known as a capital, a doogong, known as a wooden structure, and a soeseo, known as an oxtongue, thereon, wherein the member looks like a soeseo, outwards at top of the column and acts as a boaji, known as a joint, inward at top of the column. The ikkong is classified into a choikgong, known as a single-wing bracket, and a two-ikgong, known as a variation of the choikgong, depending on the number of pieces of soeseo being laid.

This gongpo functions actually to support a roof of a temple or hanok, and is a typical part boosting beauty of the temple or hanok.

However, in the case of the dapo which is a kind of this gongpo, decorative accessories such as jegong, chemcha, and so on of various styles are made by being carved, and assembled one by one on the site thus taking a lot of time in order to build a magnificent and splendid building. Accordingly, various problems are found such that, along with over expenditure in a labor cost, a construction period is longer due to time needed to assemble the decorative accessories on site, thereby, increasing labor cost.

Meanwhile, the Korean Patent No. 0869149 (Date of Publication: Nov. 19, 2008), which was published in the Korean patent publication gazette, discloses "Method for installing eaves-supporting member of traditional Korean-style house and Buddhist temple and structure thereof."

The conventional "Method for installing eaves-supporting member of traditional Korean-style house and Buddhist temple and structure thereof" above was to enhance maintainability of a gongpo, which could be seen in traditional Korean-style houses and Buddhist temples, to prevent from being completely destroyed by fire when fire occurred, and to obtain an installation method and structure of the gongpo convenient to install. In this regard, it was proposed to minimize occurrences of losses caused by a fire, a shock, an earthquake, or deterioration which might occur during the long life time of a traditional Korean-style house and Buddhist temple.

Here, the structure according to the aforementioned conventional method: is easy to be assembled and installed; has a preservation period much longer than other structures that use a method of connecting reinforcing bars because all the joint structures thereof are assembled by fitting; and has an advantage of being able to withstand an earthquake without collapse due to an effect of blocking the transmission of vibration because a foundation structure for connection is formed in two layers. However, the aforementioned conventional method has problems such that the structure is formed in a concrete structure through curing to be assembled on the construction site, whereby the manufacturing process is troublesome, and the structure formed as concrete structure is not only heavy but also vulnerable to impact, whereby installation thereof cannot be implemented quickly at the construction site, and the entire structure should be replaced when a damage occurs.

Meanwhile, a bo, known as a beam, conveys a weight of a roof on a column, meets a torii, known as a supporting member, at a right angle, and is formed in various sizes and shapes according to a size of a hanok or temple. This bo is forced to be engaged with a soro on a chemcha when meeting a gongpo placed on a column, and forms a bomeoli, known as a head of the beam, on the gongpo.

Such a bomeoli is exposed to the outside together with a gongpo, and a special decoration is engraved thereon or handiwork is realized in various configurations thereof, whereby a decorative function is given thereto.

However, even in the case of the bomeoli, it is necessary to carve various types of the bomeoli at the construction site similarly to the gongpo construction method described as above. Accordingly, various problems occur such that, along with over expenditure in a labor cost, a construction period is longer due to time needed to assemble the bomeoli on the site, thereby, increasing labor cost.

DISCLOSURE

Technical Problem

Accordingly, the present invention has been made to solve the above problems, and it is an object of the present invention to provide a hanok and temple that allow construction period to be shortened and labor cost to be reduced by simplifying the installation, maintenance, and management of the gongpo assembly structure by providing a fixing member having an interlocking slot.

In addition, it is another object of the present invention to provide the gongpo assembly structure of a hanok and temple that is economic due to use of a short member, and further enhances an esthetic sense of a hanok by allowing the inside and outside structure of the gongpo assembly structure to be separately formed, and to be installed inside and outside a building with respect to a center axis of the fixed object, respectively.

Technical Solution

In order to accomplish the above object, the present invention provides a gongpo assembly structure of a traditional Korean-style house (hanok) and temple, the gongpo assembly structure including: at least one gongpo fixing member, each provided with an interlocking slot formed in a shape depressed toward lower and inward directions from an surface thereof, and laid one upon another by being fastened to the fixed object; a judo provided with a wide open groove formed on a center of a top surface thereof and an interlocking protrusion formed on one side wall thereof and interlocked with the interlocking slot of the gongpo fixing member; and a gongpo assembled with a top of the judo, and interlocked with the interlocking slot of the gongpo fixing member.

In addition, the gongpo assembly structure may further include a fixing plate provided on a rear surface of the gongpo fixing member and fastening the gongpo assembly structure to the fixed object by being fastened to the fixed object.

In addition, the gongpo assembly structure may include: a bomeoli provided with an interlocking protrusion formed on one side wall thereof, wherein, the bomeoli is assembled by at least one bomeoli fixing member provided with an interlocking slot formed in a shape depressed toward lower and inward directions from an surface thereof and interlocked with the interlocking protrusion of the bomeoli, and laid one upon another by being fastened to the fixed object.

Here, the gongpo assembly structure may be each installed inside and outside a center axis of the fixed object of the hanok and temple, respectively, by the gongpo fixing member or the fixing plate.

In addition, the fixing plate may further include a fixing plate formed with a corner portion connecting two surfaces, and the gongpo fixing member may further include a gongpo fixing member provided with at least one interlocking slot formed in a shape depressed toward lower and inward directions from a surface thereof, and formed with the corner portion connecting the two surfaces, wherein both of the fixing plate and the gongpo fixing member are installed to the inside and outside corners of the fixed object of the hanok and temple, respectively.

Advantageous Effects

As described above, according to the present invention, it is possible to standardize and mass-produce the gongpo assembly structure at a factory. Accordingly, there are advantages that a general technician is allowed to easily do the work only done by a master previously, and an assembled gongpo assembly structure is quickly and easily installed at the construction site of the hanok and temple, wherein the gongpo assembly structure or dancheong, Korean art of painting buildings, of the gongpo assembly may be implemented at the factory rather than at the construction site of the hanok or temple. In addition, there are effects of shortening the construction period, reducing labor cost, and so on by enabling the gongpo assembly structure to be quickly assembled at the site through repair thereof as the gongpo assembly structure is easily separated from the fixed object when it is damaged.

In addition, the present invention allows the inner and outer structures of the gongpo assembly structure including the gongpo assembly structure to be separately formed, and to be installed inside and outside of the center axis of a fixed object. Accordingly, there are advantages that stress due to a load is eliminated even in the case of losses of various members due to termites eating the wood, while an esthetic sense of a hanok is further enhanced, and economic effects such as convenience of maintenance, convenience of construction, shortening of construction period, reduction in a labor cost, and so on are greatly improved.

DESCRIPTION OF DRAWINGS

FIG. 8A shows a dapo assembly structure, and FIG. 8B shows an ikkong assembly structure).

MODE FOR INVENTION

The present invention relates to a gongpo assembly structure that performs important decorative functions in a hanok and temple, and may be applied to various gongpo-styles (a dapo-style, an ikkong-style, and so on). In addition, the present invention may be applied not only to a traditional construction style but also to various construction styles by appropriate modifications of a design.

Hereinafter, the present invention will be described in detail with reference to the accompanying drawings.

Figure 1:
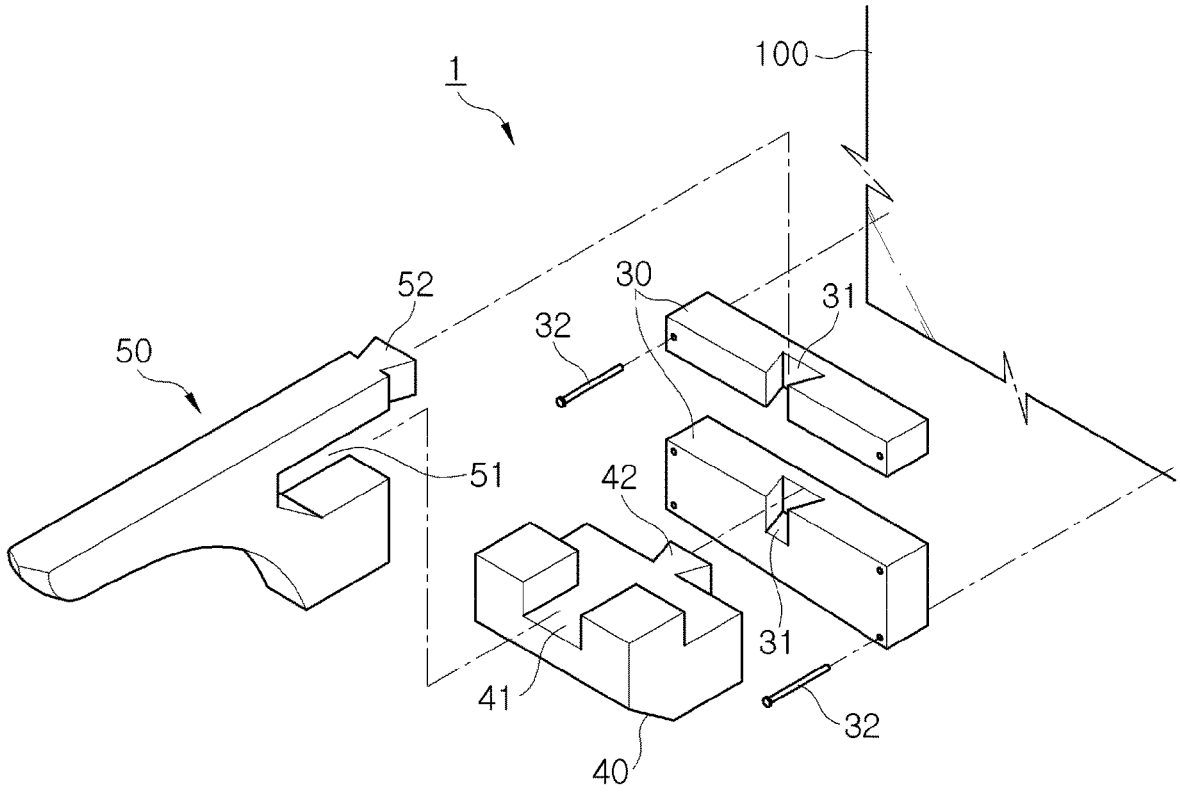
FIG. 1 is an exploded perspective view of a dapo assembly structure according to a first embodiment of the present invention.

FIG. 1 illustrates a first embodiment of the present invention, and shows an exploded perspective view of a dapo assembly structure according to the dapo-style among the gongpo-styles.

As illustrated in FIG. 1, the dapo assembly structure 1 of the dapo assembly structure according to the first embodiment of the present invention includes: at least one dapo fixing member 30 provided and laid one upon another; a judu 40 assembled with the dapo fixing member 30; and a dapo 50 assembled with the judu 40.

Here, because shapes and configurations of the dapo assembly structure 1 including the dapo fixing member 30, the judu 40 and the dapo 50 may be variously formed according to the architectural style of a temple or hanok, and sizes and the like thereof may be different, it is not preferable for the dapo assembly structure to specify or limit to the shapes shown in the first embodiment of the present invention.

The dapo fixing member 30 according to the first embodiment of the present invention is provided with an interlocking slot 31 formed in a shape depressed toward lower and inward directions from an surface thereof and is fastened to the fixed object 100, between the upper portion of the column constituting a building and the lower portion of the torii, by bolts 32.

Here, at least one dapo fixing member 30 may be formed and laid one upon another to install the dapo 50 suitable for an architectural style, wherein the dapo fixing member 30 may have different shape, size, or height, but should be provided with an interlocking slot 31, individually.

Meanwhile, the judu 40 to be interlocked with the dapo fixing member 30 by interlocking is formed with a wide open groove 41 at a center of a surface thereof and with an interlocking protrusion 42 in one side wall thereof to be inserted and interlocked with the interlocking slot 31. Accordingly, the judu 40 is assembled with the interlocking protrusion 42 being inserted into the interlocking slot 31. In addition, the dapo 50 has an inward interlocking slot 51 and an interlocking protrusion 52, and is assembled in a seated state in a wide open groove 41 of the judu 40, wherein the interlocking protrusion 52 is assembled by being inserted into the interlocking slot 31 of another different dapo fixing member 30 placed by being laid upon the dapo fixing member 30. Finally, the assembled dapo assembly structure is fastened directly to the fixed object 100 by bolts 32.

Figure 2:
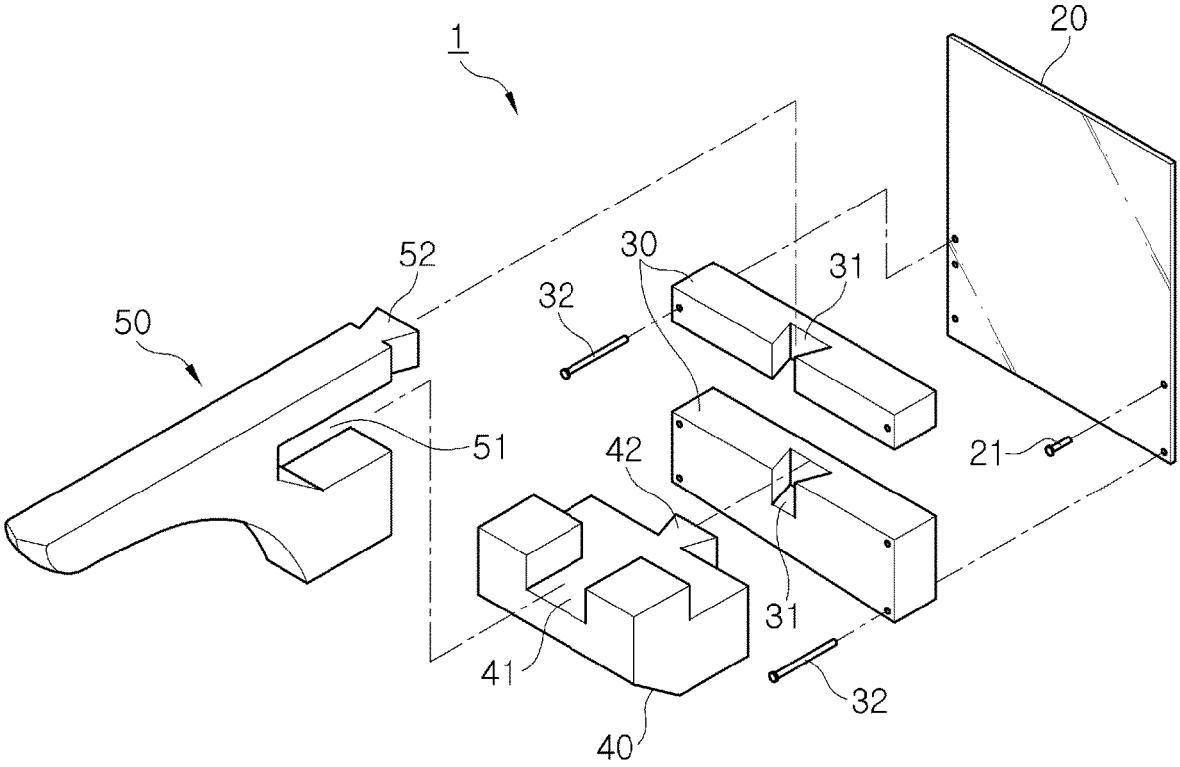
FIG. 2 is an exploded perspective view of a dapo assembly structure according to a second embodiment of the present invention.
Figure 3:
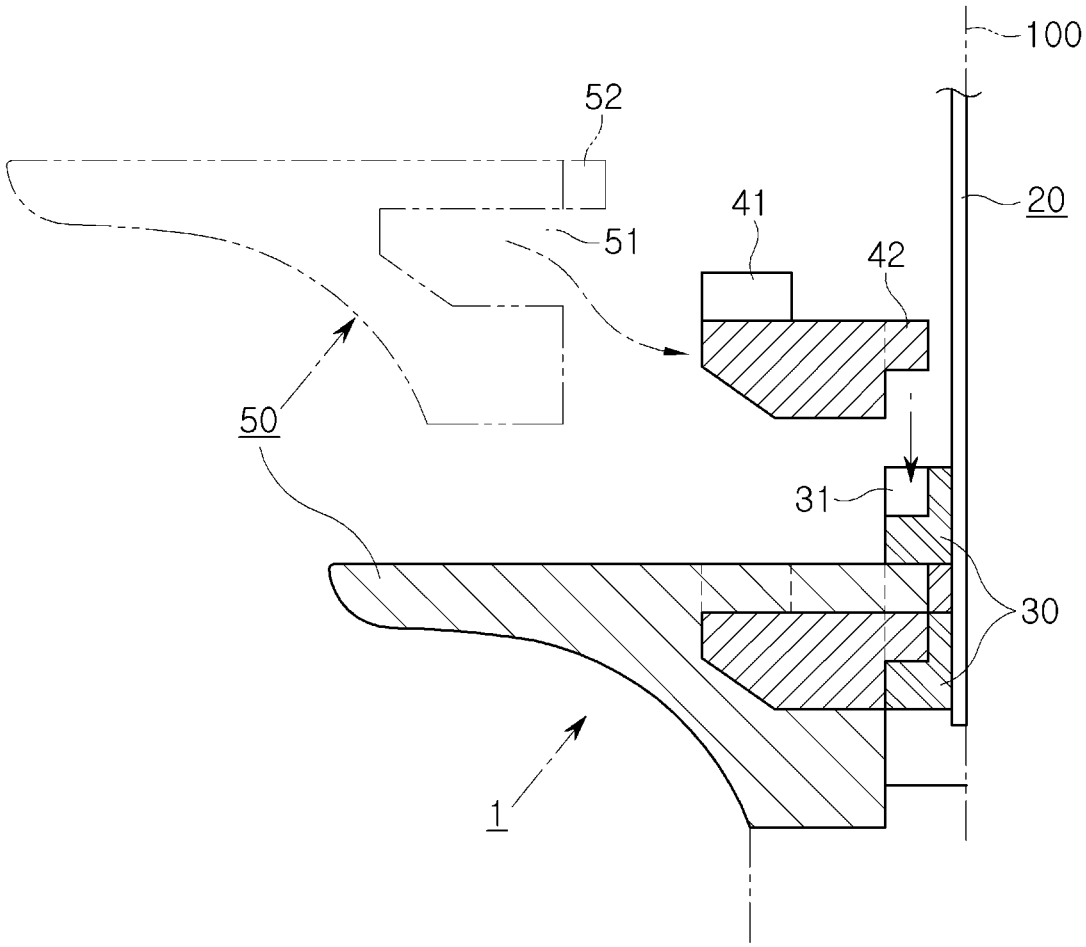
FIG. 3 is an enlarged vertical sectional view showing the assembled state of the dapo assembly structure according to FIG. 2.

FIG. 2 is an exploded perspective view of a dapo assembly structure according to a second embodiment of the present invention, and FIG. 3 is an enlarged vertical sectional view showing the assembled state of the dapo assembly structure according to FIG. 2, wherein these drawings illustrate a second embodiment of the present invention.

The second embodiment according to the present invention is, differently from the first embodiment, further provided with a fixing plate 20 fastened by bolts 21 to a horizontal or vertical surface of a part of the fixed object, between the upper part of the column constituting the building and the lower part of the torii, 100 constituting the inner and outer parts, that is, the interior and exterior of the multi-storied hanok and temple. Here, the dapo assembly structure 1 including the dapo fixing member 30 fastened to the front surface of the fixing plate 20, the judu 40 assembled with the dapo fixing member 30 by interlocking; and the dapo 50 assembled on the top of the judu 40 is fastened to the fixing plate 20 by the bolts 32 passing through the dapo fixing member 30, wherein the fixing plate 20 may be fastened to the fixed object 100 subsequently.

Figure 4:
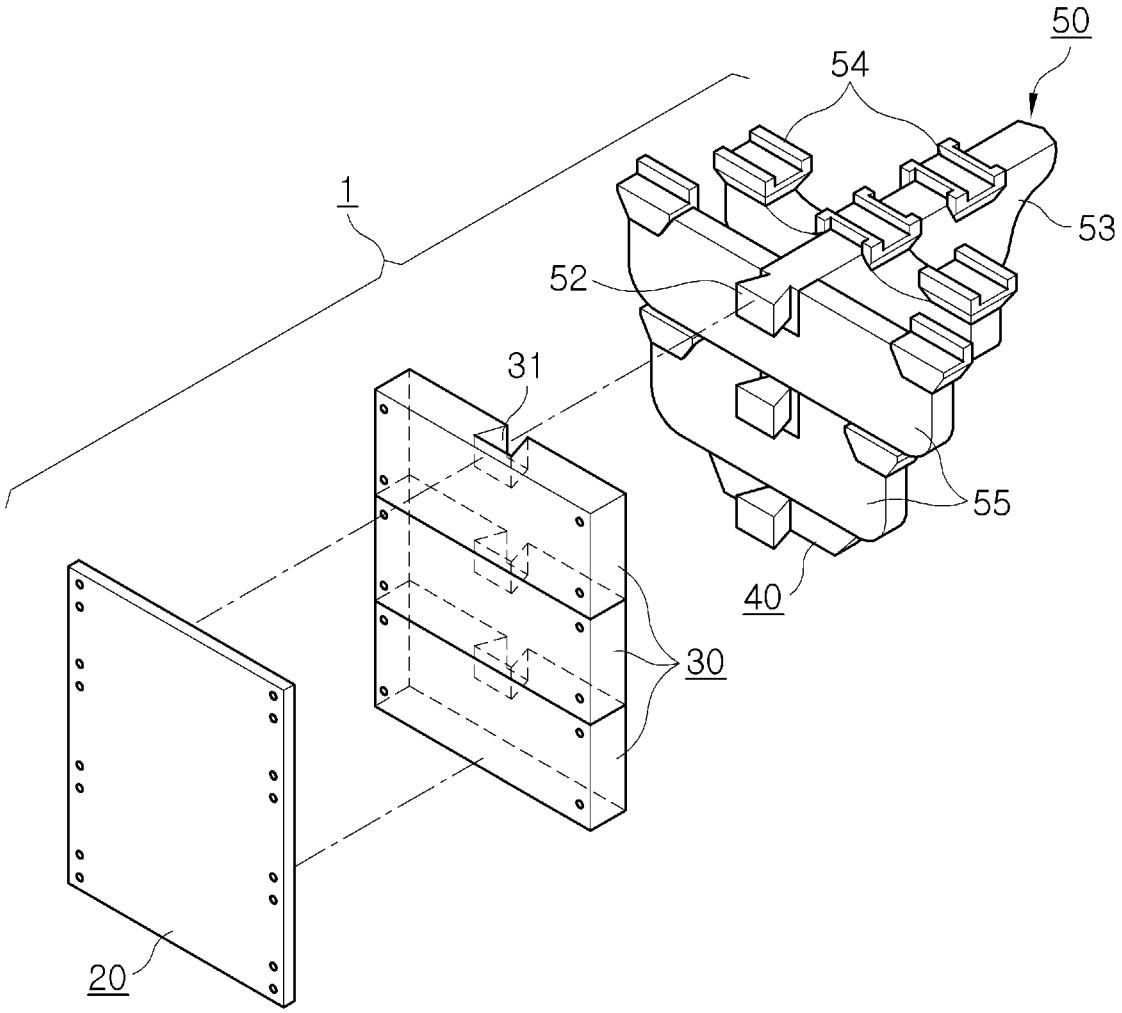
FIG. 4 is a view showing an example of a dapo assembly structure according to the present invention.

As can be seen in FIG. 4, the dapo 50 as above according to the dapo assembly structure of the hanok and temple according to the present invention is composed of the judu 40, a salmi 53, a soro 54, a chemcha 55, and so on. Since the dapo assembly structure 1 including the dapo 50 is designed to be suitable for the style of the hanok and temple to be constructed, and can be formed in one of various shapes, sizes, or heights, it needs not for the dapo assembly structure 1 to be specific or limited to the drawings illustrated in the present invention.

The dapo assembly structure 1 according to the first and second embodiments of the present invention is mass-produced in a standardized state at a factory, thereby allowing a general technician to perform work only done by a master previously, and the construction period to be shortened due to dancheong that may be performed in advance at the factory other than at the construction site of the hanok and temple.

A plurality of dapo fixing members 30 are installed on one selected from the fixed object 100 and the fixing plate 20 according to the present invention, wherein, in front of the dapo fixing members 30, the interlocking protrusion 42 of the judu 40 is assembled by being inserted into the interlocking slot 31 of the dapo fixing member 30.

In addition, the interlocking slot 51 of the dapo 50 is inserted on the top of the judu 40 from the outside of the judu 40 and the interlocking protrusion 52 of the dapo 50 is inserted into and assembled with the interlocking slot 31. Subsequently, the completely assembled dapo assembly structure 1 is completed to be installed by being fastened on the site on the horizontal or vertical surface of the fixed object 100 or the fixing plate 20 constituting the multi-storied hanok and temple.

When the dapo assembly structure 1 according to the present invention is assembled in advance at the factory, the construction period on the site may be greatly shortened. Here, the number of dapo assembly structures 1 fastened to the fixed object 100 or the fixing plate 20 may vary depending on the style of the hanok and temple.

Figure 5:
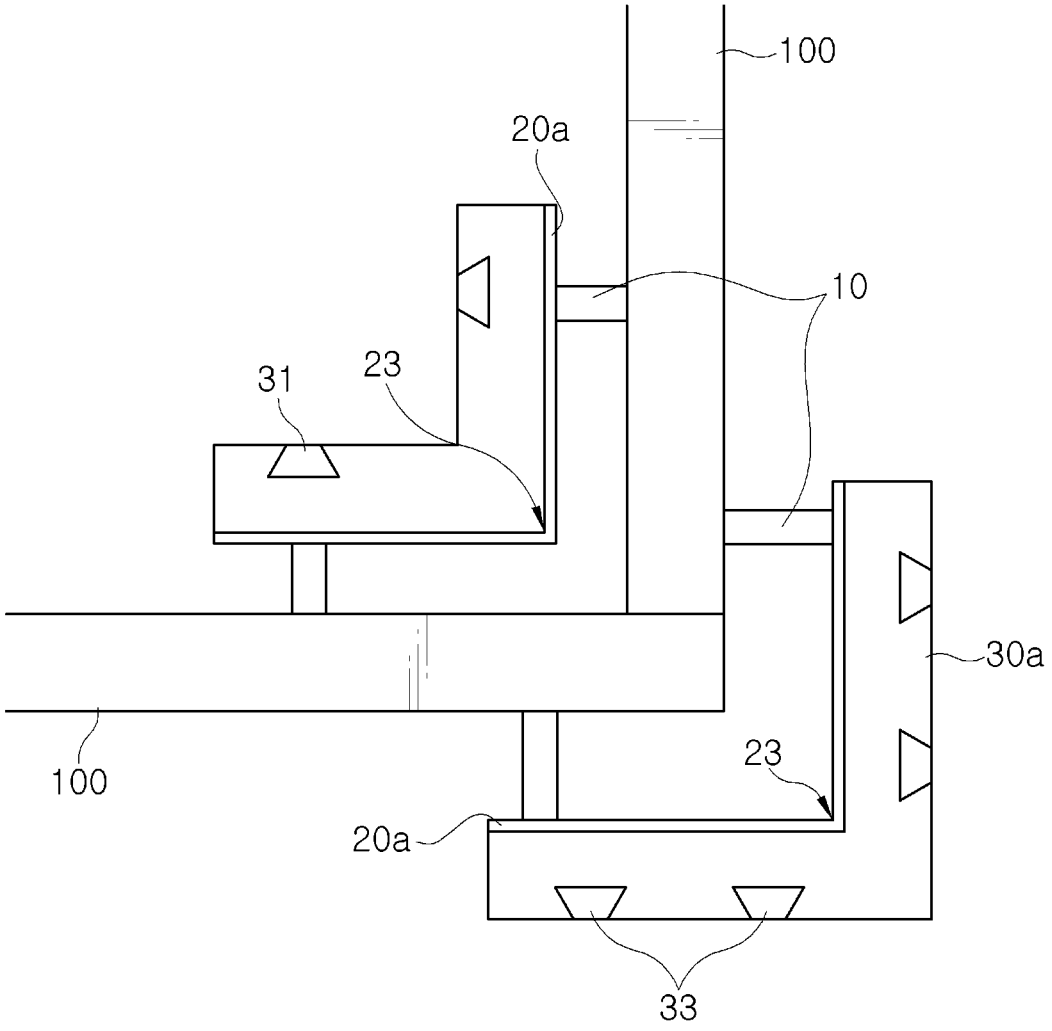
FIG. 5 is a view showing an example of dapo assembly structures according to the present invention each constructed at the inside and outside corners of a hanok and temple, respectively.

Meanwhile, FIG. 5 is a view showing an example of dapo assembly structures according to the present invention each constructed at the inside and outside corners of a multi-storied hanok and temple, respectively, wherein another example of the fixing plate 20 and the dapo fixing member 30 can be seen.

As can be seen in the abovementioned drawing, a fixing plate **20*a* is formed with a corner portion 23 connecting two surfaces. That is, the dapo fixing member 30*a* is provided with at least one interlocking slot 33 formed in a shape depressed toward the lower and the inward directions from a surface thereof, and with the corner portion 23 connecting the two surfaces, whereby the dapo fixing member 30*a* can be quickly and easily installed to the inside and outside corners which are the inside and outside of the fixed object 100 of the multi-storied hanok and temple, respectively. Here, in the same way, the fixing plate 20*a* is fastened by the bolt 32 to a bracket 10 fastened to the fixed object 100, and the dapo fixing member 30*a* is also fastened by the bolt to the fixing plate 20*a*. Here, reference numeral 10 denotes a bracket that is to place the fixing plate 20*a* spaced apart from the fixed object 100** as necessary, and may not be necessarily needed.

Figure 6:
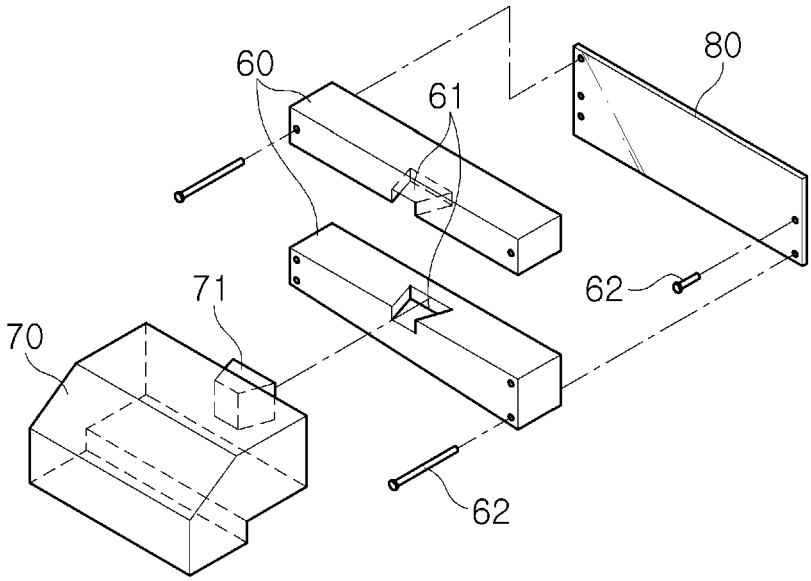
FIG. 6 is an exploded perspective view of a bomeoli assembly structure according to a third embodiment of the present invention.
Figure 7:
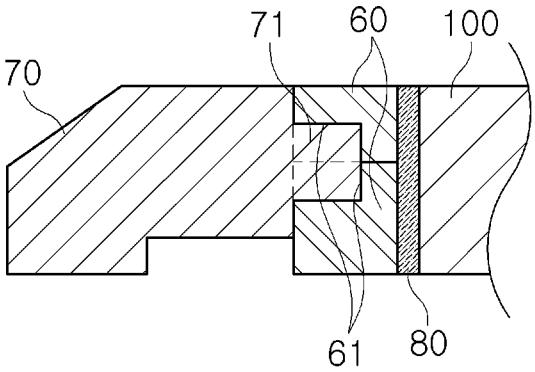
FIG. 7 is an enlarged vertical sectional view showing an assembled state of the bomeoli assembly structure according to FIG. 6.

FIG. 6 is an exploded perspective view of a bomeoli assembly structure according to a third embodiment of the present invention, and FIG. 7 is an enlarged vertical sectional view showing an assembled state of the bomeoli assembly structure according to FIG. 6.

The third embodiment relates, differently from the first and second embodiments, to a bomeoli assembly structure that is installed on one side of top of a column by being added to the dapo-style or the ikkong-style of the gongpo-styles of the hanok and temple.

Similarly to the first embodiment, the bomeoli assembly structure includes: at least one bomeoli fixing member 60 provided with an interlocking slot 61 formed in a shape depressed toward the lower and inward directions from an surface thereof, and laid one upon another by being fastened to the fixed object 100 by the bolts; and a bomeoli 70 provided with an interlocking protrusion 71 formed in the one side wall thereof, and interlocked in the interlocking slot 61.

The shape and configuration of the bomeoli 70 can be variously formed according to the architectural style of the temple or hanok, and the size and the like can be varied. In addition, the bomeoli assembly structure may be further provided on one side of a bo placed on top of the dapo assembly structure. Accordingly, it is not preferable for the bomeoli assembly structure to be specific or limited to the shape or configuration shown in the third embodiment of the present invention.

As in the first and second embodiments, the bomeoli fixing member 60 according to the third embodiment of the present invention is provided with an interlocking slot 61 formed in a shape depressed toward the lower and the inward directions from an surface thereof the same as the dapo fixing member, and fastened to the fixed object that is a top side of a dapo assembly structure, a top side of a column, a one side of a Bo, or an end of the Bo, 100 by the bolt 62.

Here, at least one bomeoli fixing member 60 may be formed and laid one upon another to install the bomeoli 70 suitable for an architectural style, wherein the bomeoli fixing members 60 may have different shape, size, or height, but should be provided with an interlocking slot 61, individually.

The bomeoli assembly structure is assembled by inserting the interlocking protrusion 71 of the bomeoli 70 into the interlocking slot 61 formed in the bomeoli fixing member 60. According to the architectural style, a plurality of pieces of the bomeoli in various shapes can be formed and coupled by being assembled with the bomeoli fixing member 60 and other bomeoli. To this end, separate interlocking slots and interlocking protrusions may be formed in the bomeoli similarly to the dapo assembly structure.

As described above, the bomeoli assembly structure may be directly formed with the bomeoli 70 being fastened to the fixed object (a top side of a dapo assembly structure, one side of a bo, or an end of the bo) 100 by the bolts 62 with the interposition of the bomeoli fixing member 60. However, the bomeoli assembly structure may be further provided with a fixing plate 80 fastening the bomeoli 70 to the fixed object 100, wherein the fixing plate 80 is placed between the rear surface of the bomeoli fixing member 60 and the fixed object 100, and fastened to the fixed object 100 by the bolts 62.

Similarly to the second embodiment of the present invention, this is to further provide the fixing plate 80 fastened between the bomeoli fixing member 60 and the fixed object 100 by the bolts 62, and to allow the bomeoli 70 or the bomeoli assembly structure to be fastened to the fixing plate 80 by the bolt 62 passing through the bomeoli fixing member 60, whereby the fixing plate 80 is fastened to the fixed object 100 subsequently.

In the case where the bomeoli 70 is composed of a plurality of pieces of the bomeoli in various shapes and sizes and is formed as a single bomeoli assembly structure, this is to fasten the single bomeoli assembly structure to the fixing plate 80 first, and then to fasten the fixing plate 80 fastening the single bomeoli assembly structure to the fixed object 100. The single bomeoli assembly structure, no matter how complex it is, is fastened to the fixing plate 80 in advance and is only coupled with the fixed object 100 subsequently, thereby enabling installation by any general technician. Accordingly, shortening of a construction period and reducing of a labor cost may be realized.

Meanwhile, although the above embodiment has been described in detail regarding the dapo-style among the gongpo-styles, the present invention is not limited thereto, and can be applied to the ikkong-style as well as to the hanok or temple appropriately according to the architectural style thereof.

Figure 8A:
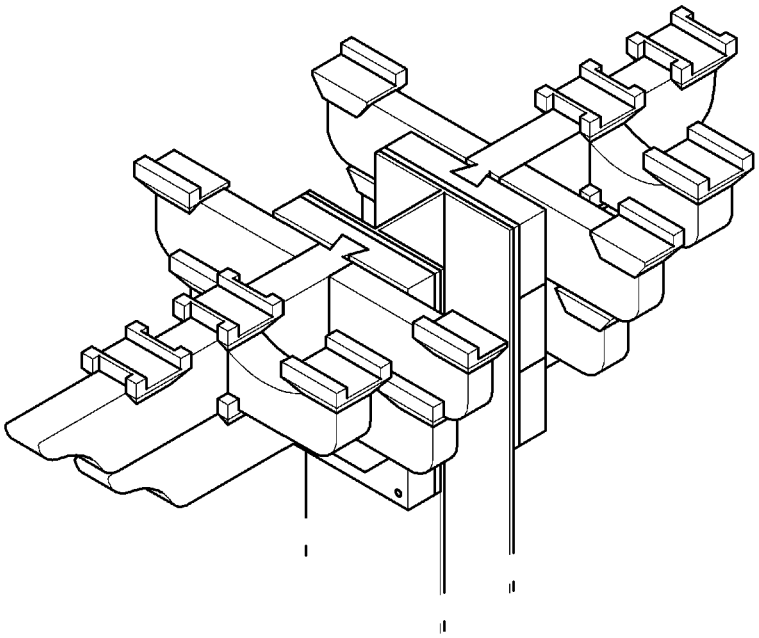
FIG. 8A and FIG. 8B illustrate views of various application examples of the present invention
Figure 8B:
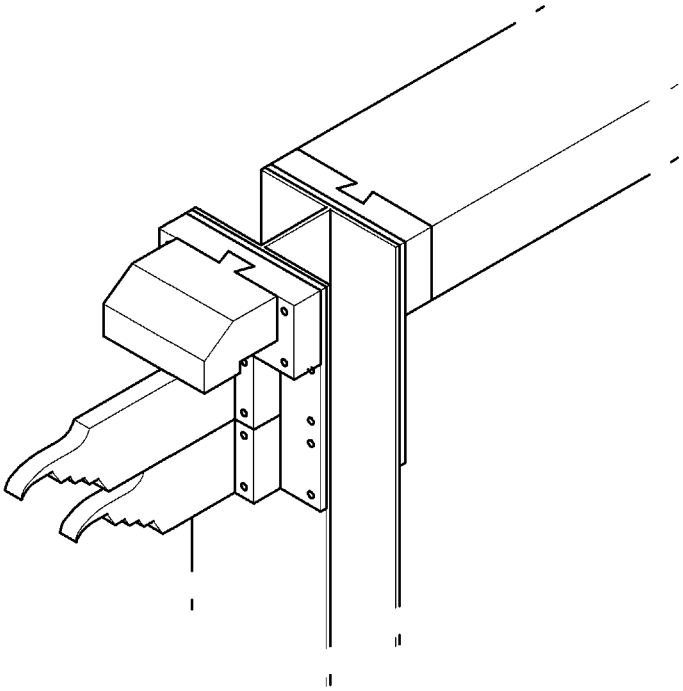

FIG. 8 illustrates views of various application examples of the present invention, wherein (a) shows a dapo assembly structure, and (b) shows an ikkong assembly structure. These drawings illustrate examples that the present invention may be applied to the dapo-style and the ikkong-style.

As shown in FIG. 8, the gongpo assembly structure like this is preferably installed by the gongpo fixing member or the fixing plate inside and outside the building, respectively, with respect to the center axis of the fixed object of the hanok or the temple.

That is, the gongpo assembly structure is required to form integrally with inner and outer decorative members in the existing hanok, wherein each of component and connection structure thereof should be assembled all by fitting. Consequently, there are problems that the gongpo assembly structure in the existing hanok is difficult to install and the entire gongpo assembly structure should be replaced when a part thereof is to be replaced due to breakage.

However, the present invention allows basically the inner and outer configurations of the gongpo assembly structure including the gongpo assembly structure, for example, the dapo assembly structure or the ikkong assembly structure, to be provided separately and to be installed inside and outside the building with respect to the center axis of the fixed object, respectively.

To this end, the present invention introduces a gongpo fixing member or a fixing plate, and allows effects such as convenience of construction, shortening of construction period, reduction in a labor cost, and so on to be realized by a method of fastening the gongpo fixing member and the fixing plate coupled with the gongpo assembly structure to the fixed object.

Particularly, the present invention may be applicable to a multi-storied hanok or temple. In addition, the present invention may be applied not only to a traditional hanok architecture but also to a composite architecture which uses a method deviated from the traditional one, wherein the composite architecture provides a hanok or temple with a structure formed in a steel structure, H beam, and uses the steel structure and wood. In this regard, FIG. 8 shows that the gongpo assembly structure according to the present invention is installed inside and outside the fixed object steel structure, in this composite construction method.

Accordingly, the present invention is possible to realize not only a single-storied but also a multi-storied hanok, and to minimize problems such as the loss of various members due to termites eating the wood, whereby it is possible to realize a building that is convenient for repair, maintenance and management, and is excellent in durability.

Especially, the assembled gongpo assembly structure can be installed quickly and conveniently at a site after completing the gongpo by assembling at a factory rather than a construction site, wherein the gongpo is most important for decorative purposes in the hanok architectural style, and takes a relatively long time for installation. As a result, while enhancing an esthetic sense of a hanok, the present invention greatly improves economic effects such as convenience of maintenance, convenience of construction, shortening of construction period, reduction in a labor cost, and so on.

As described above, the present invention can enable quick and easy assembly of the gongpo assembly structure, prefabricated quickly and easily at the factory, at the construction site of the hanok, or multi-storied house, and temple, thereby reducing the construction period of the hanok and temple, reducing labor cost, and providing convenience for maintenance and management. In addition, the gongpo assembly structure can be quickly replaced after being easily separated from the fixed object in the case of breakage.

As above, the terms and words used in the present specification and claims should not be construed in a conventional sense or as defined in a dictionary. The present invention should be construed in accordance with the meaning and concept consistent with the technical idea of the present invention based on a principle that the inventor is entitled to define properly the concept of the term in order to describe its invention in the best way possible.

Accordingly, the first to third embodiments and the configurations illustrated in the drawings are only preferred embodiments of the present invention, and do not represent all of the technical ideas of the present invention. Consequently, it should be understood that various equivalents and modifications might be possible at the time of the application.

The invention claimed is:

1. A structure of a traditional Korean-style house and temple, the structure comprising:

a plurality of gongpo assembly structure each including:

a gongpo fixing member fastened to a fixed object and having a lower gongpo fixing member part in which a lower interlocking slot portion is formed and an upper gongpo fixing member part stacked on the lower gongpo fixing member part and in which an upper interlocking slot portion is formed;

a judu provided with a wide open groove formed on a center of a top surface thereof and an interlocking protrusion formed on one side wall thereof and interlocked with the lower interlocking slot portion of the lower gongpo fixing member part;

a gongpo assembled with a top of the judu, and interlocked with the upper interlocking slot portion of the upper gongpo fixing member part, and a fixing plate provided between the gongpo fixing member and the fixed object and fastening the gongpo fixing member to the fixed object, wherein the lower interlocking slot portion extends downward from a top surface of the lower gongpo fixing member part and has a height lower than the lower gongpo fixing member part, such that a lower surface of the lower interlocking slot portion supports the interlocking protrusion of the judu, the upper interlocking slot portion extends between a top surface and a bottom surface of the upper gongpo fixing member, the lower interlocking slot portion and the upper interlocking slot portion are arranged in one vertical line, and some of the gongpo assembly structures are installed inside a center axis of the fixed object of the traditional Korean-style house and temple and some other of the gongpo assembly structures are installed outside the center axis of the fixed object of the Korean-style house and temple, by the gongpo fixing member or the fixing plate.

2. A gongpo assembly structure of a traditional Korean-style house and temple, the gongpo assembly structure comprising:

a gongpo fixing member fastened to a fixed object and having a lower gongpo fixing member part in which a lower interlocking slot portion is formed and an upper gongpo fixing member part stacked on the lower gongpo fixing member part and in which an upper interlocking slot portion is formed;

a judu provided with a wide open groove formed on a center of a top surface thereof and an interlocking protrusion formed on one side wall thereof and interlocked with the lower interlocking slot portion of the lower gongpo fixing member part; and a gongpo assembled with a top of the judu, and interlocked with the upper interlocking slot portion of the upper gongpo fixing member part, and a fixing plate provided between the gongpo fixing member and the fixed object and fastening the gongpo fixing member to the fixed object; and wherein the lower interlocking slot portion extends downward from a top surface of the lower gongpo fixing member part and has a height lower than the lower gongpo fixing member part, such that a lower surface of the lower interlocking slot portion supports the interlocking protrusion of the judu, the upper interlocking slot portion extends between a top surface and a bottom surface of the upper gongpo fixing member, the lower interlocking slot portion and the upper interlocking slot portion are arranged in one vertical line, the fixing plate is formed to have a corner portion connecting two flat portions, and the gongpo fixing member has a same shape as the fixing plate, and both of the fixing plate and the gongpo fixing member are installed to the inside or outside corner of the fixed object of the Korean-style house and temple.

* * * * *